United States Patent [19]

Thompson

[11] 4,103,952

[45] Aug. 1, 1978

[54] COMBINATION BAG AND SCOOP

[76] Inventor: John Douglas Thompson, 2660 Midland Ave., Agincourt, Ontario, Canada

[21] Appl. No.: 794,834

[22] Filed: May 9, 1977

[51] Int. Cl.[2] ..... A01K 29/00; A47L 13/52

[52] U.S. Cl. ..... 294/1 R; 206/216; 229/62; 294/55

[58] Field of Search ..... 294/1 R, 19 R, 25, 55; 15/104.8, 257.1, 257.6, 257.7, 257.9, 236 R; 150/3, 12; 206/216; 229/53, 62, 66

[56] References Cited

U.S. PATENT DOCUMENTS

| | | | |
|---|---|---|---|
| 2,093,976 | 9/1937 | Farmer | 229/62 |
| 2,766,927 | 10/1956 | Wallace | 229/62 |
| 2,980,314 | 4/1961 | Adams | 229/65 |
| 3,286,826 | 11/1966 | Stoll | 229/53 X |
| 3,558,038 | 1/1971 | Gelles et al. | 150/12 X |
| 3,676,887 | 7/1972 | Klein | 229/62 X |
| 3,767,247 | 10/1973 | Wetzler | 294/1 R |
| 3,830,423 | 8/1974 | Prescott | 294/1 R X |
| 3,978,540 | 9/1976 | Peck et al. | 294/1 R X |

*Primary Examiner*—Johnny D. Cherry

[57] ABSTRACT

The specification describes a combination bag and scoop used for cleaning up waste material when walking one's pet. The bag includes a closed bottom portion for holding waste material and an upper portion having an open mouth for insertion of waste material into the bag and closing means for closing the bottom portion of the bag after placing waste material therein. The bottom portion is constructed of a flexible, impermeable material such as high density polyethylene. The upper portion which is also preferably constructed of a high density polyethylene includes two relatively flat parallel sidewalls adjacent to one another. Each of the sidewalls is provided with a finger insert at one end thereof with both of the inserts located at the same end of the upper portion. The upper portion is rigid to the extent that upon insertion of a finger and a thumb or a pair of fingers in the inserts, the mouth can be spread open by bowing the sidewalls. However, the upper portion is also resilient to the extent that upon withdrawal of a finger and a thumb from the inserts, the sidewalls resume their flat parallel relationship. The scoop includes a handle and a scooping portion for scooping waste material into the bag when the mouth is spread open. The scoop is placed in the bag after use and the bottom portion is then closed by the closing means to substantially eliminate spillage and odors.

7 Claims, 6 Drawing Figures

COMBINATION BAG AND SCOOP

FIELD OF THE INVENTION

This invention relates to a bag for use with a scoop for cleaning waste material and more particularly for cleaning animal excretion.

BACKGROUND OF INVENTION

Due to the fact that an increasing number of people now own pets, many parks and recreational areas include numerous restrictions with respect to walking a pet to protect the environment. In fact, a number of laws have been put into effect which require that the owner clean up all excrement after a dog has defecated. These laws have been put into effect because of the health hazards which are a major problem in today's society. Therefore people are forced to carry some type of a container such as a cut down milk container and a shovel so that they can clean up any mess which is left by the pet when walking it.

As can be appreciated it is very awkward and cumbersome to carry a container and a shovel while walking the pet and people do not look forward to this tedious task.

It is therefore an object of the present invention to provide a bag for use with a scoop for cleaning animal excretion when walking one's pet, thereby keeping parks and recreational areas clean allowing a person to have more peace of mind and to be kinder and more thoughtful to his friends and neighbors.

It is another object of the present invention to provide a bag for use with a scoop which is portable and very easily carried in one's pocket and which can be used for cleaning waste material when walking one's pet.

It is therefore another object of the present invention to provide a bag for use with a scoop used for cleaning animal excretion to combat an increasing health hazard in today's society.

It is a further object of the present invention to provide a bag for use with a scoop which is very inexpensive and which can be disposed of after being used.

It is yet another object of the present invention to provide a bag for use with a scoop which is easy and clean to use when cleaning animal excretion.

It is yet a further object of the present invention to provide a bag and scoop which can be used for cleaning animal excretion from various different surfaces.

It is still another object of the present invention to provide a bag which can be closed to substantially eliminate spillage and odours after having cleaned up after a pet when walking the animal.

BRIEF SUMMARY OF THE INVENTION

The bag according to this invention includes a bag having a bottom portion and an upper portion. The upper portion includes an opening so that waste material can be placed in the closed portion of the bag. The bottom portion is impervious so that it is capable of holding various types of waste material. The bottom portion is also quite flexible so that it will conform to, and hold a large amount of waste material.

The upper portion consists of two sidewalls which are relatively flat, parallel and adjacent to one another before use. Each of the sidewalls is provided with a finger insert and both of the finger inserts are located at the same end of the upper portion of the bag. Both of the sidewalls are rigid relative to the bottom portion of the bag so that upon insertion of the finger and thumb in the finger inserts, the mouth of the bag can be spread open by separating the finger and the thumb to bow or arch the two sidewalls. When the mouth of the bag is spread open by separating the thumb and the finger, the bag is placed on the ground and excrement is scooped into the bag with the scoop. Also as a result of the rigidity of the sidewalls, and the location of the finger inserts, the sidewalls will remain bowed or arched when the bag is lifted from the ground when holding excrement for shaking the bag or inserting further excrement. As earlier mentioned the finger inserts are located at or near the end of the upper portion and therefore one's finger and thumb do not get in the way of the scooping operation when scooping the waste material into the bag, thereby making the operation a very clean one.

The scoop itself includes a handle and a scooping portion. After having completed the scooping operation the scoop is placed in the bag with the other contents. While the sidewalls of the upper portion are more rigid than the lower portion, they are still resilient to the extent that upon withdrawal of the thumb and the forefinger from the inserts, the sidewalls tend to resume their flat, parallel relationship to facilitate closing of the bag and its contents. The bag includes closing means to close the bottom portion of the bag and its contents to substantially eliminate spillage and odours.

The bag has a size and shape which makes it portable so that the scoop can be carried in the bag with the bag in a person's pocket prior to use. The bag and scoop are very inexpensive to manufacture and purchase and therefore the combination makes a very practical disposable unit.

BRIEF DESCRIPTION OF THE DRAWINGS

The aforementioned and other objects, advantages and features of the invention will become apparent from the following detailed description of the preferred embodiments of this invention wherein.

DETAILED DESCRIPTION OF THE PREFERRED EMBODIMENTS

Figure 2:
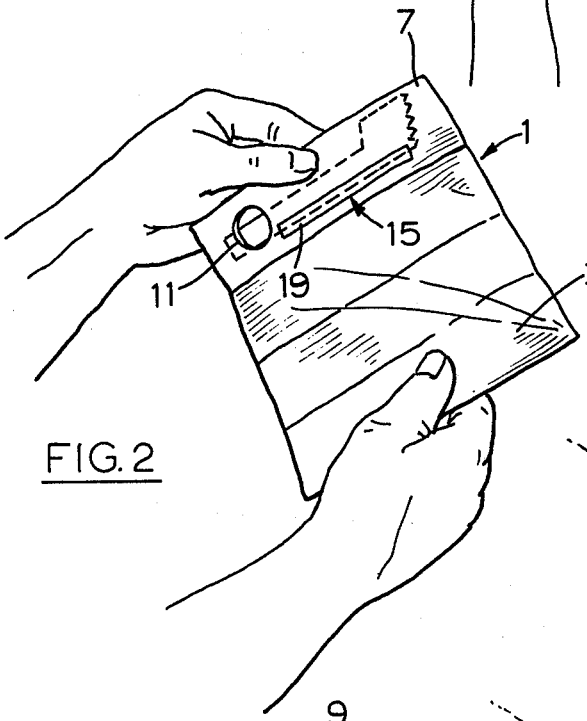
FIG. 2 is a view of a person unfolding a combination bag and scoop after having removed it from his pocket.

As best shown in FIG. 2, the bag generally indicated at 1 is provided with a bottom portion 3 and an upper portion 7. Bottom portion 3 includes two side panels 5, which are secured to one another along their periphery to provide an internal compartment 6 capable of holding waste materials W. The bottom portion can also be gussetted to provide a larger internal compartment than that shown in the figures.

The upper portion 7 of bag 1 includes two sidewalls 9 which are secured to one another at their outer edges but unsecured along their top edges to provide an opening 10 to the interior 6 of the bag. Each of the sidewalls 9 is provided with a finger insert in the form of hole 11 and both finger inserts are located at one end of the upper portion.

One of the side panels 5 is provided with a closing means 15 including a strip of adhesive material 17 covered and protected by a piece of tape 19 which is removed without detracting from the adherent properties of adhesive 17 when it is desired to close the bag.

In another embodiment of the invention the bag includes a closing means in the form of a male, female locking arrangement to completely seal the bottom portion of the bag. The female portion is located along the lower edge of one of the sidewalls and the male portion is located on the other sidewall opposite the female portion.

Scoop 21 includes a handle portion 23 and a scooping portion 25. The scooping portion 25 is provided with scooping edges 27 and 29.

Both of the side panels 5 of bottom portion 3 are constructed of a high density polyethylene having a thickness of approximately 1½ mils. As can be appreciated they could also be constructed of any other impervious flexible material such as polypropylene. Furthermore, side panels 5 can be opaque and a pleasing colour so that the bag is pleasant to look at even when it is filled with waste material. In this embodiment, sidewalls 9 of upper portion 7 are also constructed of a high density polyethylene although sidewalls 9 are much thicker than side panels 5 and range from approximately 8–12 mils in thickness. Side panels 5 are provided by means of a blown film extrusion process. The sidewalls of the upper portion which are made in a separate extrusion process are then heat sealed to the bottom portion to form a bag having a very flexible bottom portion and a more rigid upper portion.

In another embodiment of the invention the entire bag is formed by a blown film extrusion process. The upper portion of the bag is then formed by folding the polyethylene upon itself and placing a resilient stiffener in the folded portion of the bag. A mechanical tongue is inserted in the bag and the folded portion of the bag is heat sealed along its lower edge to secure the resilient stiffener in the fold. Holes 11 can be die cut or stamped either before or after sealing the upper portion to the lower portion.

Figure 1:
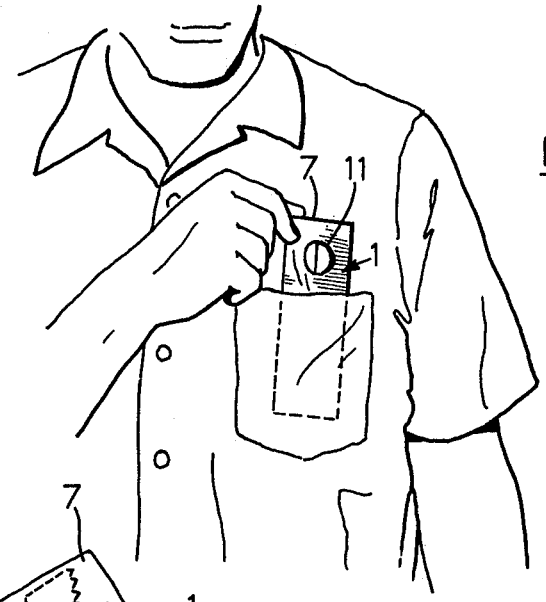
FIG. 1 is a view of a person carrying a combination bag and scoop in his pocket in a folded condition.

Prior to using the bag it can be folded with the scoop 21 placed inside the bag and carried in a person's pocket as shown in FIG. 1. Therefore, the combination bag and scoop is portable and eliminates the problem of carrying a number of awkward utensils as presently required when walking one's pet. In order to prepare the bag for use it is simply removed from one's pocket and unfolded. The scoop is then removed from the interior of the bag.

Figure 3:
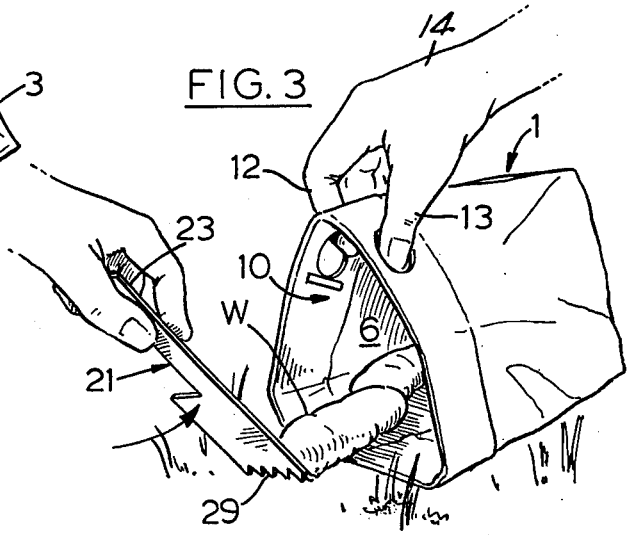
FIG. 3 shows a combination bag and scoop when in use.

When using the bag, as shown in FIG. 3, a forefinger 12 and a thumb 13 on the same hand are placed in holes 11. As can be appreciated a pair of fingers could also be used. The thumb and the forefinger are spread apart and as they are spread, sidewalls 9 which are normally flat and parallel in an adjacent relationship begin to bow and arch to spread open mouth 10 of bag 1. Forefinger 12 and thumb 13 should be spread until the mouth of the bag is open to the extent shown in FIG. 3.

The bag is then placed on the ground in the area of the animal excrement with the mouth of the bag at approximately right angles to the surface which is to be cleaned. If it is desired to open the mouth of the bag still farther, one simply exerts a downward force on the bag with the hand which is engaging the finger inserts, thereby further bowing or arching sidewalls 9. The bag is now in a position to begin the scooping operation.

It should be noted from the above that only one hand has been required to place the bag in a position to begin the scooping operation. This ease in manipulation is accounted for by two features of the bag. The first feature is the provision of the finger inserts which are accessibly located on the side walls of the upper portion and the second feature is the relative stiffness or firmness of the upper portion of the bag. This rigidity is of course dependent on the thickness of the plastic or stiffener used in constructing the upper portion. As can be appreciated if the sidewalls of the upper portion were not relatively stiff, they could not be bowed outwardly from one another as shown in FIG. 3 with any degree of regularity from bag to bag. However, because they are stiff and because of the positioning of the finger inserts, the side walls of the upper portion will invariably bow outwardly to open the mouth of the bag by merely spreading the forefinger and the thumb. As stated earlier, if it is desired to open the mouth of the bag farther than is possible by merely spreading the forefinger and the thumb a downward force can be placed on the bag by the hand holding the mouth open.

It is to be understood that various types of finger inserts could be used. For example the holes in the upper sidewalls could be replaced by a pair of external loops which would fulfill the same function.

When the bag is in position to begin the scooping operation the waste material W is scooped through the open mouth by means of scoop 21. The scoop is held by handle 23 and the waste material only comes in contact with scooping portion 25. If the waste material is located on a flat surface it is advisable in most cases to perform the scooping operation by placing flat edge 27 of scooping portion 25 downwardly and forcing the waste material through the open mouth of the bag. The flat edge should be used to clean the surface even if it is not used during the scooping operation. However, if the waste material is located on an irregular surface, such as a grassy surface, it is easier and more efficient to perform the scooping operation by placing serrated or irregular edge 29 of scooping portion 25 on the grassy or irregular surface and scooping the waste material into the bag.

As best shown in FIG. 3, neither forefinger 12, thumb 13 nor hand 14 comes into contact with the waste material W thereby making the operation a very cleanly one. The forefinger and the thumb are remote from the scooping area because of the location of the finger inserts at the end of the upper portion remote from the waste material. Hand 14 is also remote from the waste material due to the provision of the handle 23 on scoop 21.

When the scooping operation has been completed scoop 21 is placed in the interior of the bag with the waste material W. Strip 19 is then removed by pulling in the direction of arrow 20 to expose a strip of adhesive 17 extending across the major portion of the diameter of the upper portion of the bag slightly below hole 11. Prior to closing the bag, tape 19 protects strip of adhesive 17 from exposure to foreign material which would detract from the adhesive's adherent properties. After the tape has been removed, it is also placed in the interior of the bag. Again it should be noted that the closing means 15 is remote from the area in which the waste material was scooped into the bag so that no waste material comes into contact with the closing means.

Figure 5:
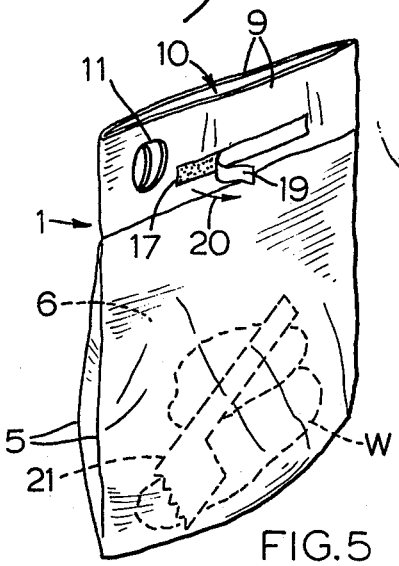
FIG. 5 is a view of a bag and its contents prior to closing according to this invention.

Forefinger 12 and thumb 13 are then withdrawn from finger inserts 11. Although the sidewalls of the upper portion do require a certain amount of rigidity as above described, they are also resilient to the extent that upon withdrawal of the thumb and the forefinger they spring toward their flat, parallel adjacent relationship, as best shown in FIG. 5. Again, it should be noted that the closing of the bag is a very clean operation because it does not require any handling of the bag in the area of the scooping operation and in fact, the bag can almost be called an automatic self-closing bag.

Figure 6:
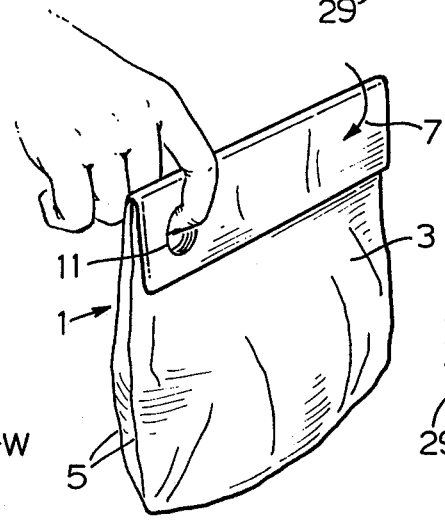
FIG. 6 is a view of the bag and its contents after closing and when ready for disposal in a waste disposal unit.
Figure 4:
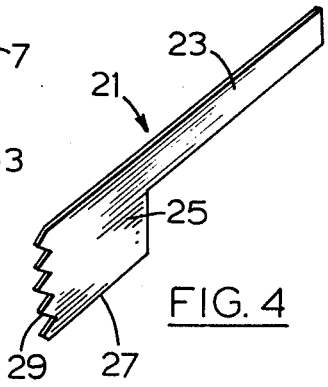
FIG. 4 is a perspective view of the scoop shown in FIG. 3.

Upper portion 7 provided with adhesive 17 which has now been exposed is folded upon bottom portion 3 and adhesive strip 17 adheres to one of the side panels 5 of the bottom portion to close the bag and its contents as shown in FIG. 6. Adhesive strip 17 does not extend to the very edge of the bag and therefore a finger can be placed through the finger inserts 11 to carry the bag to a waste disposal unit. However, it is understood that the strip of adhesive could extend across the entire diameter of the bag and the bag could be carried to the waste disposal unit by grasping it with a thumb and forefinger at the corner of the bag.

When working with the male, female sealing arrangement described above, the male and female portions on the respective sidewalls are aligned and a force is exerted on both portions to engage the male portion in the female portion to seal the internal compartment of the bag.

In another embodiment of the invention the closing means is located between the upper sidewalls of the bag. It is again in the form of a strip of adhesive covered by a protective tape. However according to this embodiment the closing means is at approximately right angles with respect to the mouth of the bag and is located on the inner surface of one of the sidewalls inwardly of the finger insert but remote from the scooping area. In order to close the bag the tape is removed and the upper sidewalls are pressed together. Due to the stiffness of the sidewalls the single strip is adequate to essentially eliminate spills and odors from the bag and because of the location of the strip there is no need to handle the bag in the scooping area.

In some instances the bag can be used on its own for the cleaning of hardened excrement and from the above it can be seen that there has been provided a unique bag which is generally used in combination with a scoop for cleaning all types of solid animal excretion. It is quickly and easily manipulated in a very cleanly manner and is readily disposed of after use. Furthermore, the combination bag and scoop according to this invention eliminates the necessity of carrying awkward and cumbersome tools while walking one's pet through a park or recreational area and therefore makes the walk far more cheerful and pleasant.

Although various preferred embodiments of the invention have been described herein in detail, it will be understood by those skilled in the art that variations can be made thereto without departing from the spirit of the invention or the scope of the appended claims.

I claim:

1. A bag used for cleaning waste material, said bag including a closed bottom portion for holding waste material, an upper portion having an open mouth for insertion of waste material into said bag, and closing means for closing said bag after inserting waste material therein, said bottom portion being constructed of a flexible impermeable material, said upper portion including two relatively flat parallel sidewalls adjacent one another, each of said sidewalls being provided with a finger insert at one end thereof such that both of the inserts are located at the same end of the upper portion, said upper portion being rigid to the extent that upon insertion of a finger and a thumb or a pair of fingers in said inserts said mouth is spread open by spreading a finger and a thumb and bowing said sidewalls, said upper portion also being resilient to the extent that upon withdrawal of a finger and a thumb from said inserts said sidewalls tend to resume their flat parallel relationship, the size of the bag being such that it is easily opened by one hand with the thumb and finger firmly engaged in said finger inserts, said closing means being located on said bag such that said bottom portion is closed after use by the closing means for closing said bag and its contents.

2. A bag as claimed in claim 1 wherein said bottom portion is made from high density polyethylene so that it is both durable and liquid impervious.

3. A bag as claimed in claim 2 wherein said bottom portion includes two side panels approximately $1\frac{1}{2}$ mils in thickness and wherein said sidewalls of said upper portion are from 8–12 mils in thickness.

4. A bag as claimed in claim 1 wherein said closing means constitutes a strip of adhesive at the lower end of said upper portion said strip of adhesive being covered by a piece of tape which is removed prior to closing so that said upper portion is secured to said bottom portion by said strip of adhesive when folded upon said bottom portion.

5. A bag as claimed in claim 1 wherein said closing means comprises a strip of adhesive covered by a protective tape located on the inner surface of one of said sidewalls adjacent to the finger insert on said one of said sidewalls, said strip of adhesive and tape being orientated at approximately 90° with respect to said mouth.

6. A combination bag and scoop for cleaning waste material, said bag including a closed bottom portion for holding waste material, an upper portion having an open mouth for insertion of waste material into said bag, and closing means for closing said bag after inserting waste material therein, said bottom portion being constructed of a flexible impermeable material, said upper portion including two relatively flat parallel sidewalls adacent one another, each of said side walls being provided with a finger insert at one end thereof such that both of the inserts are located at the same end of the upper portion, said upper portion being rigid to the extent that upon insertion of a finger and a thumb or a pair of fingers in said inserts said mouth is spread open by spreading a finger and a thumb and bowing said sidewalls, said upper portion also being resilient to the extent that upon withdrawal of a finger and a thumb from said inserts said sidewalls tend to resume their flat parallel relationship, the size of said bag being such that it is easily opened by one hand with the thumb and finger firmly engaged in said finger inserts, said scoop including a handle and a scooping portion for scooping waste material into said bag when said mouth is spread open, said closing means being located on said bag such that said bottom portion is closed after use by the closing means for closing said bottom portion and its contents.

7. A combination bag and scoop as claimed in claim 6 wherein said scooping portion is provided with two scooping edges, one of said edges being flat for use on a smooth contour, the other of said edges being serrated for use on a rough or irregular contour.

* * * * *